US011197566B2

(12) United States Patent
Aresu

(10) Patent No.: US 11,197,566 B2
(45) Date of Patent: Dec. 14, 2021

(54) APPARATUS FOR RECEIVING MAIL

(71) Applicant: Daniele Aresu, Montano Lucino (IT)

(72) Inventor: Daniele Aresu, Montano Lucino (IT)

( * ) Notice: Subject to any disclaimer, the term of this patent is extended or adjusted under 35 U.S.C. 154(b) by 196 days.

(21) Appl. No.: 16/497,221

(22) PCT Filed: Apr. 17, 2018

(86) PCT No.: PCT/IB2018/052654

§ 371 (c)(1),
(2) Date: Sep. 24, 2019

(87) PCT Pub. No.: WO2018/193371

PCT Pub. Date: Oct. 25, 2018

(65) Prior Publication Data

US 2020/0046155 A1 Feb. 13, 2020

(30) Foreign Application Priority Data

Apr. 20, 2017 (IT) ..... 102017000043619

(51) Int. Cl.
*A47G 29/124* (2006.01)
*A47G 29/14* (2006.01)

(52) U.S. Cl.
CPC ..... *A47G 29/124* (2013.01); *A47G 29/141* (2013.01); *A47G 2029/1257* (2017.08)

(58) Field of Classification Search
CPC ..... A47G 29/12; A47G 29/124; A47G 29/20; A47G 29/141; A47G 2029/1257; G07C 9/00912; E05B 65/0075
(Continued)

(56) References Cited

U.S. PATENT DOCUMENTS 5,624,071 A * 4/1997 Sosan ..... A47G 29/20 232/1 B
5,850,967 A 12/1998 White
(Continued)

FOREIGN PATENT DOCUMENTS

DE 4334005 A1 4/1995
DE 202013004989 U1 7/2013
EP 3150090 A1 4/2017

OTHER PUBLICATIONS

English machine translation of DE202013004989.
English machine translation of DE4334005.
English machine translation of EP3150090.

*Primary Examiner* — William L Miller
(74) *Attorney, Agent, or Firm* — Dickinson Wright PLLC; Andrew D. Dorisio

(57) ABSTRACT

An apparatus for receiving mail with a body having a main inner cavity for containing a mail item, a movable closing element for allowing or preventing access to the main inner cavity, a through opening for allowing the insertion of the mail item inside the main inner cavity, and a locking device electronically actuated with a first user interface element for allowing the input of a signal for locking and/or unlocking. The first user interface element can be accessed from outside the apparatus for receiving mail. An electric power supply is for supplying the locking device and the respective user interface element, respectively. Emergency opening equipment has a second user interface element, with connecting means for the locking device, and an unlocking device configured for unlocking the locking device by way of the connecting means, in case of malfunction of said locking device and/or of the first user interface element.

11 Claims, 3 Drawing Sheets

(58) Field of Classification Search
USPC ..... 232/17, 19, 38, 45; 70/63, 159; 109/66
See application file for complete search history.

(56) References Cited

U.S. PATENT DOCUMENTS

| | | | | |
|---|---|---|---|---|
| 6,426,699 | B1 * | 7/2002 | Porter | A47F 10/00 221/2 |
| 7,256,691 | B2 * | 8/2007 | Awobue | A47G 29/124 340/545.6 |
| 10,016,083 | B1 * | 7/2018 | Atieh | A47G 29/1214 |
| 10,321,780 | B1 * | 6/2019 | James | A47G 29/141 |
| 10,383,471 | B1 * | 8/2019 | Barnes | A47G 29/20 |
| 10,537,196 | B1 * | 1/2020 | MacPherson | A47G 29/20 |
| 10,709,276 | B2 * | 7/2020 | Guanch | A47G 29/20 |
| 10,743,695 | B1 * | 8/2020 | Altmaier | A47G 29/20 |
| 10,786,103 | B2 * | 9/2020 | Teoh | A47G 29/20 |
| 2013/0147626 | A1 | 6/2013 | Hammoud | |
| 2015/0001283 | A1 | 1/2015 | Morris et al. | |

* cited by examiner

APPARATUS FOR RECEIVING MAIL

TECHNICAL FIELD

The present invention relates to an apparatus for receiving mail according to the pre-characterizing portion of the main claim.

More specifically, the present invention relates to a mailbox.

BACKGROUND

Currently, mailboxes are known, in which the incoming mail is left by the postal carrier.

The known mailboxes have an inner compartment which is closed by a door, which usually is formed by at least a part of the front panel of the box. Obviously, the mailbox further comprises a through opening so as to allow the postal carrier to insert the mail into the inside thereof. The door is provided with a locking device which comprises a lock, operated by a corresponding key, held by the user of the mailbox, to which the incoming mail is addressed.

A problem felt by users is indeed the need to have a key to open the mailbox. In fact, the key is often small and therefore difficult to find. It follows that the user must make avoidable efforts in order to access the received mail.

Another problem related to the key lies in the risk of losing it, which would entail a cost to remake a new key, or even lead to the need of replacing the entire mailbox.

Therefore, mailboxes have been made with electronic systems which, in addition to or in place of the traditional key lock, can open or at least facilitate the opening thereof. For example, document DE 4334005 A1 discloses a mailbox wherein an electronic system is provided which, however, has as main function that of indicating the presence or absence of mail in said mailbox. Document U.S. Pat. No. 5,850,967 A discloses a security mailbox having the purpose of protecting the respective contents from break-in attempts. To achieve said object, the mailbox according to U.S. Pat. No. 5,850,967 A is provided with an electronic opening system which is additional to the traditional key lock. Document DE 202013004989 U1 discloses a mailbox integrated into an intercom apparatus. The mailbox according to DE 202013004989 U1 is provided with an electronic system whose function is essentially to control said intercom apparatus. As can be seen from the text and from the figures of DE 202013004989 U1, in fact, the mailbox illustrated therein is provided with a traditional mechanical locking device.

A drawback of the mailboxes provided with integrated electronic systems, whether they are designed to perform the opening of the same or not, is linked to possible malfunctions in emergency conditions and/or possible electric power supply interruptions. In these cases, in fact, it would be impossible for the user to access the mail contained in the mailbox.

SUMMARY

An object of the present invention is therefore to provide an apparatus for receiving mail provided with an electronic opening system that can be operated even in emergency conditions and/or possible electric power supply interruptions, allowing the user to access the mail in an easy and effortless manner.

Another object of the present invention is to provide an apparatus for receiving mail which allows to avoid the loss of the key.

These and other objects are achieved by providing an apparatus for receiving mail made according to the technical teachings of the appended claims.

The apparatus for receiving mail comprises a body provided with an inner cavity, configured for containing at least one mail item, with a movable closing element, configured for allowing or preventing access to said inner cavity, with a through opening, configured for allowing the insertion of the mail item inside the inner cavity, and with a locking device of the movable closing element. The locking device is of the electronically actuated type and comprises an interface element configured for allowing the input of a signal for locking and/or unlocking the locking device. The interface element can be reached from outside the apparatus for receiving mail. The apparatus comprises an emergency opening equipment comprising in turn a user interface element, provided with connecting means with the locking device, and at least one unlocking device, configured to perform the unlocking of the locking device by means of said connecting means in the event of malfunction of the locking device itself and/or of the interface element.

BRIEF DESCRIPTION OF THE DRAWING FIGURES

Further characteristics and advantages of the invention will become apparent from the description of a preferred but not exclusive embodiment of the apparatus for receiving mail, illustrated by way of example and therefore not limitative in the attached drawings, wherein.

DETAILED DESCRIPTION OF THE INVENTION

Figure 1:
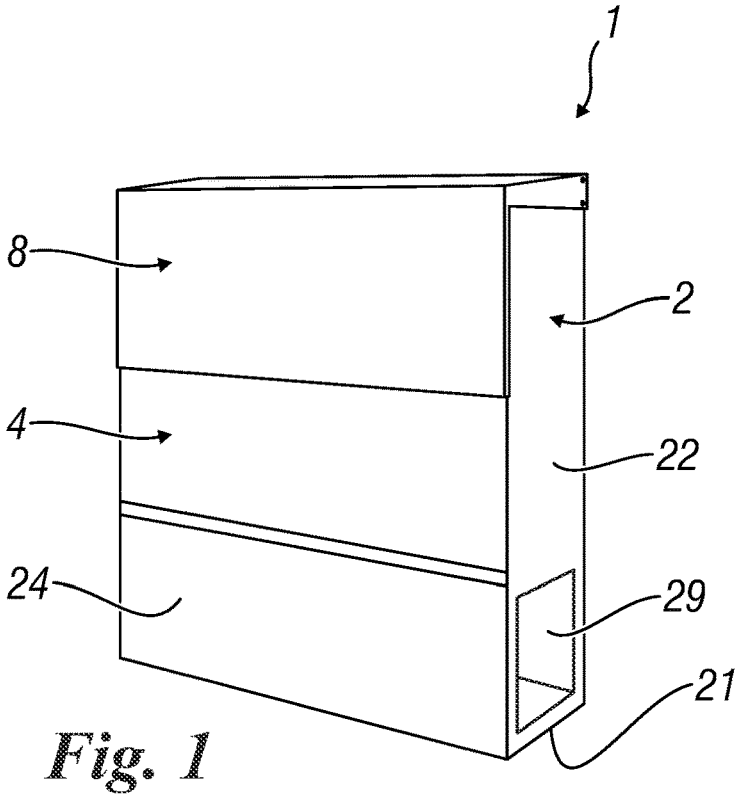
FIG. 1 is a perspective view of the apparatus for receiving mail in a closed configuration and with the interface element covered.

With reference to the aforementioned figures, they show an apparatus 1 for receiving mail, that is, a mailbox.

The apparatus 1 comprises a body 2 provided with a main inner cavity 3 configured for containing at least one mail item. By mail item, a letter written on paper, and possibly folded and enclosed in an envelope, is intended. It is possible to foresee that said mail item could also be a package.

The body 2 comprises, furthermore, a movable closing element 4 configured for allowing or preventing access to the main inner cavity 3.

Typically, the body 2 comprises an upper wall 20, a lower wall 21, two side walls 22, a rear wall 23 and a front wall 24. It is particularly advantageous to provide that the movable closing element 4 is precisely the front wall 24, suitably hinged to one of the upper wall 20, the lower wall 21 or the side walls 22 (as illustrated in the figures).

Figure 3:
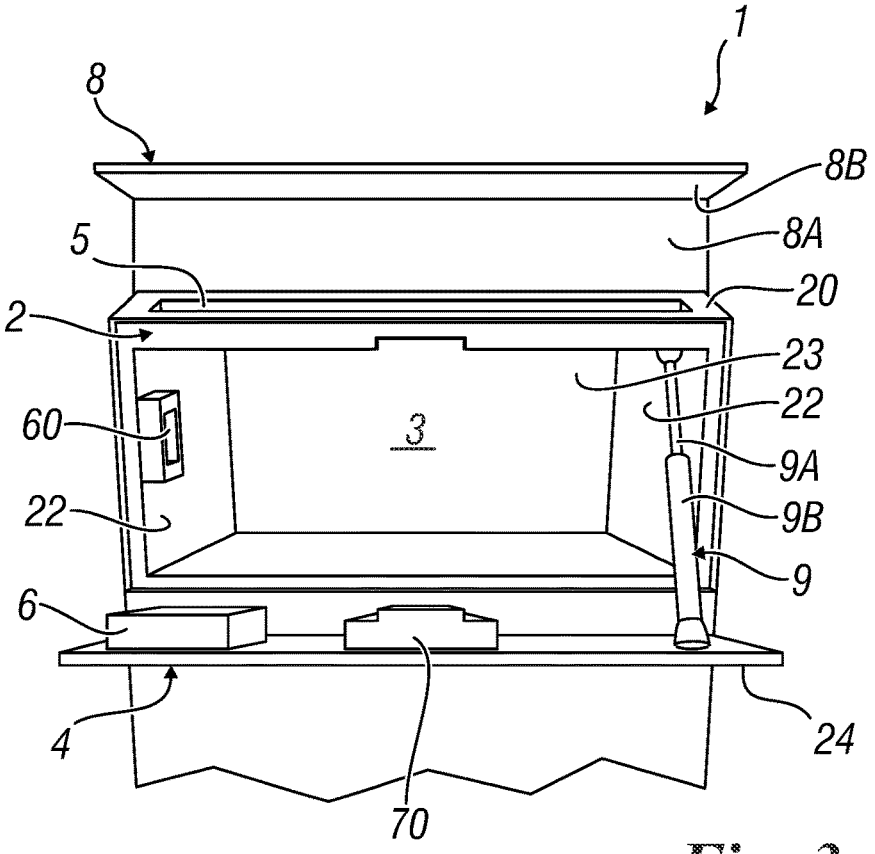
FIGS. 3 and 4 are a front perspective view and a lateral perspective view of the apparatus, object of the invention, in an open configuration, respectively.

The body 2 comprises furthermore a through opening 5 configured for allowing the insertion of the mail item inside the main inner cavity 3, without, however, having to open the movable closing element 4. In the illustrated embodiment, the through opening 5 has a slot shape, configured for allowing the passage of letters or documents with a reduced volume (FIG. 3).

It is advisable that the through opening 5 has a size so that it is not possible to access the main inner cavity 3 through the same, i.e. it does not allow the passage of a hand.

The body 2 also comprises a locking device 6 of the movable closing element 4. The locking device 6 is of the electronically actuated type. Said locking device 6 comprises a first user interface element 7 configured for allowing the input of a signal for locking and/or unlocking the locking device 6, said first user interface element 7 being reachable from outside the apparatus 1 for receiving mail.

The electronically actuated locking device 6 thus allows the traditional key lock to be replaced with a keyless lock. It is no longer necessary to have a key to be able to unlock the locking device 6 and then open the movable closing element 4, but it is sufficient to input an unlocking signal or, on the contrary, a locking signal if it is desired to lock the movable closing element 4 again.

The type of locking or unlocking signal changes according to the type of user interface element 7 provided.

In the preferred embodiment, illustrated in the figures, the first user interface element 7 comprises an alphanumeric or numeric keypad. The keypad can be of the physical type (with push-buttons) or digital, provided on a touch screen (as provided in the illustrated embodiment). The locking and/or unlocking signal consists in an alphanumeric or numeric code to be input via the keypad.

Figure 4:
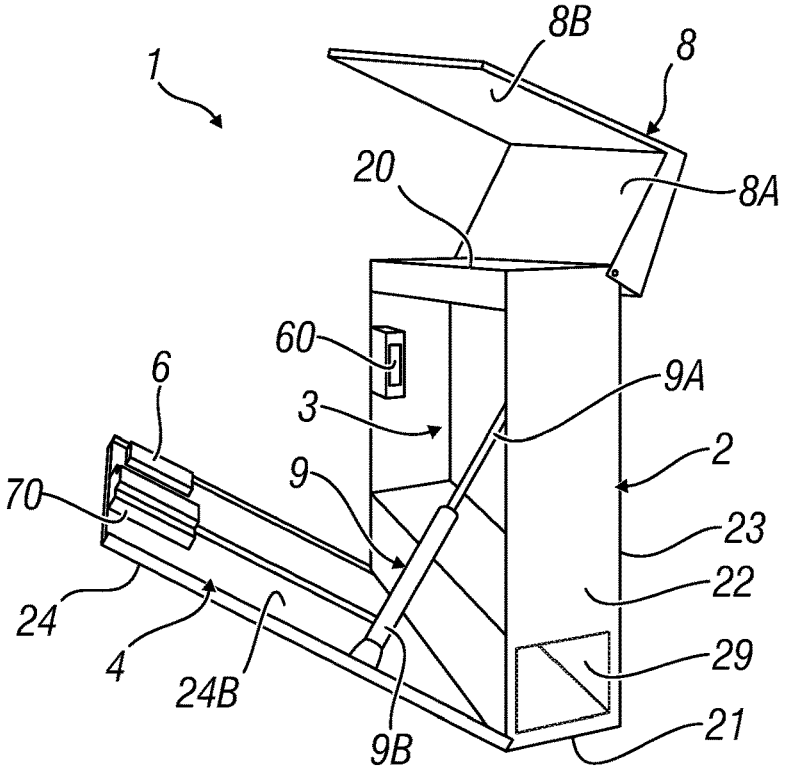
Figure 5:
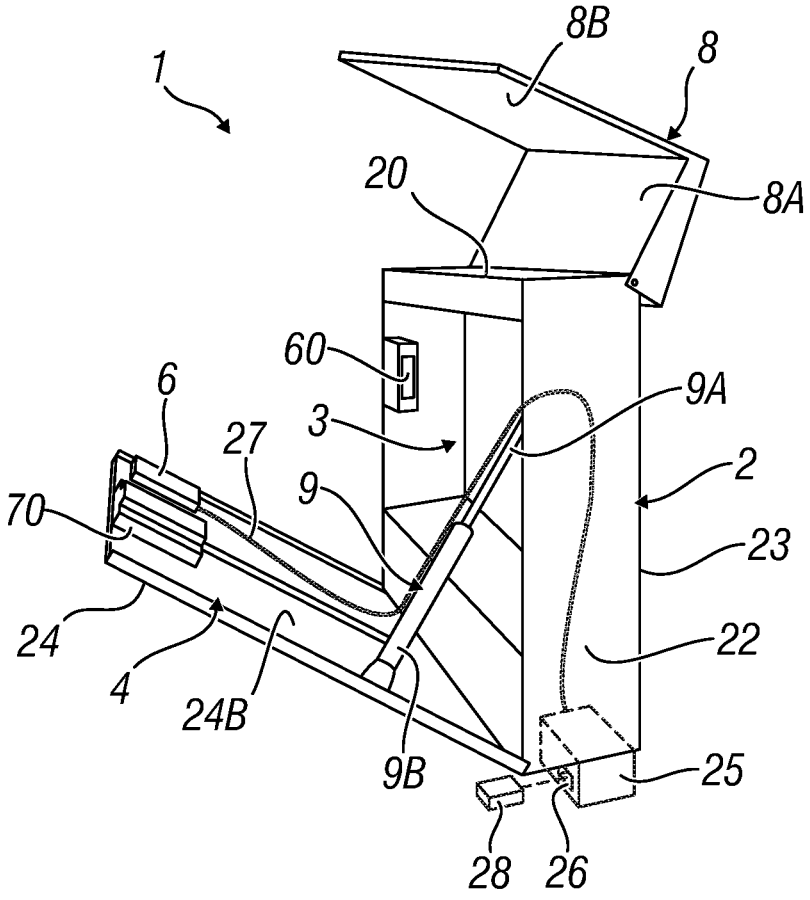
FIG. 5 is a side perspective view of the apparatus, object of the invention, in an open configuration and with some components of the apparatus itself highlighted.

As can be understood from the figures, particularly from FIG. 3, the touch screen is preferably arranged flush with the front wall 24 of the body 2. It follows that the touch screen has its own body 70 which projects from the front wall 24 towards the inside of the main inner cavity 3 of the mailbox 1 (FIGS. 3-5). It is also possible to provide a respective removable protection element (not illustrated in the figures) adapted to cover the body 70 of the touch screen in order to protect it, for example from the weather.

It is possible to provide that the first user interface element 7 comprises a fingerprint reader. The locking and/or unlocking signal is input by scanning the fingerprint of the user, or users. The fingerprint reader can be provided as an alternative to the keypad, or in addition to it, as illustrated in the figures (in particular in FIG. 2).

It should be noted that the first user interface element 7 is not limited to the types mentioned above but can also comprise, for example, a programmable key card, a RFID (Radio-Frequency Identification) or NFC (Near Field Communication) proximity system, a Bluetooth system, a voice recognition and control system, a remote-control system via Wi-Fi connection, a smartphone application, one or more biometric recognition sensors or one or more owner identification sensors.

It is also advantageous to provide a movable protection element 8 adapted to be moved between a first position (FIG. 1), in which it covers the first user interface element 7, and a second position (FIGS. 2-5), in which it leaves free access to the first user interface element 7.

It is even more advantageous to provide that the movable protection element 8, when covering the first user interface element 7, also covers the through opening 5.

Figure 2:
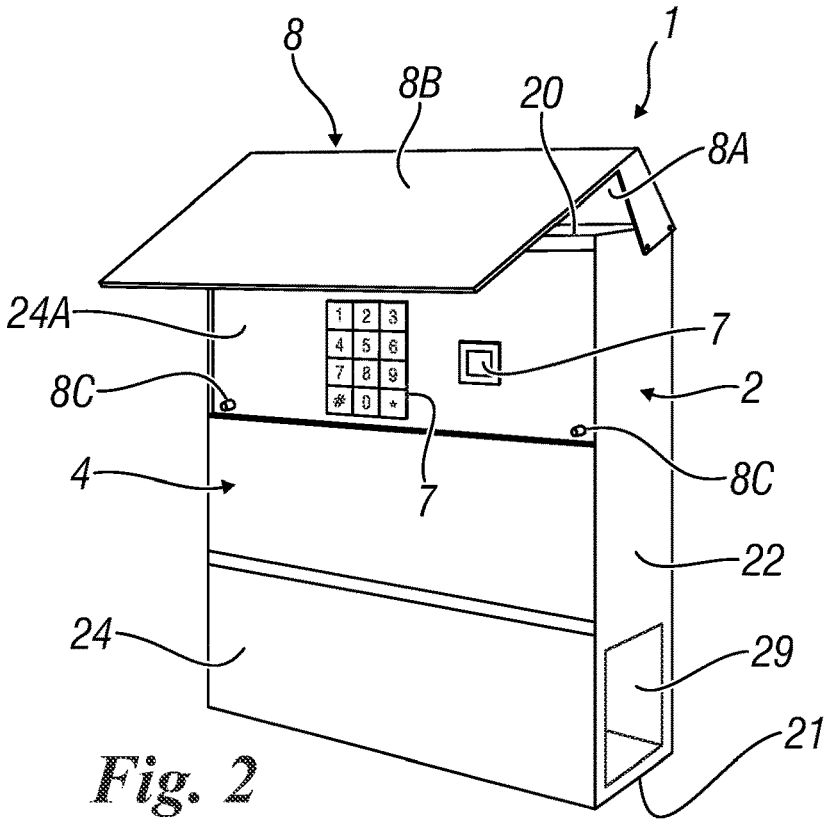
FIG. 2 is a perspective view of the apparatus of FIG. 1, in a closed configuration and with the interface element accessible.

For example, in the preferred embodiment, illustrated in the figures, the through opening 5 is provided on the upper surface 20 of the body 2 (FIG. 3), and the first user interface element 7 is arranged on the front surface 24 near the upper edge (FIG. 2). The movable protection element 8 comprises a lid hinged to the upper surface 20 and provided with a first panel 8A suited for covering the upper surface 20, and therefore the through opening 5, and a second panel 8B connected to the first panel 8A and suited for covering an upper portion 24A of the front wall 24, and therefore the first user interface element 7.

It should be noted that, in an advantageous but not obligatory manner, the body 2 is also provided with damping elements 8C of the movable protection element 8 at the upper portion 24A of the front wall 24. In the illustrated embodiment (FIG. 2) said damping elements 8C comprise a pair of grommets.

It is preferable that the locking device 6 is arranged on the movable closing element 4. In the preferred embodiment, said locking device 6 is arranged on the inner surface 24B of the movable closing element 4, that is, of the front wall 24 of the body 2. The locking device 6 is advantageously provided at one of the edges of the movable closing element 4, even more preferably at the opposite edge with respect to the one hinged to the body 2.

It is also advisable to provide a counter-locking device 60 preferably arranged within the main inner cavity 3 and configured for cooperating with the locking device 6 so as to effectively enable the locking of the movable closing element 4, for example a simple fixed fin, or a counter-seat for a possible tab protruding from the locking device 6. However, it is advantageous that the counter-locking device 60 is arranged in proximity to the locking device 6 when the apparatus 1 is closed. In the illustrated embodiment the counter-locking device 60 is in fact arranged on the inner surface of the left side wall 22 and in an upper portion thereof.

The apparatus 1 preferably comprises a supporting element 9 for the movable closing element 4, configured for supporting the latter when it is in the open position. The supporting element 9 is connected both to the movable closing element 4 and to the body 2 of the apparatus 1 and, in the illustrated embodiment, it is of the pneumatic type. In fact, it comprises a piston 9A inserted in a sliding manner in a cylindrical body 9B. In said case the supporting element 9 also has a damping function for the opening of the movable closing element 4.

In the illustrated embodiment the piston 9A is connected to the body 2 of the apparatus 1, whereas the cylindrical body 9B is connected to the movable closing element 4. It is obviously possible to provide the opposite configuration, namely that the piston 9A is connected to the movable closing element 4 and that the cylindrical body 9B is connected to the body 2.

It is also to be noted that the electronically actuated locking device 6, as well as the related user interface element 7, are powered by respective electric power supply means. In the illustrated embodiment, the electric power supply means are formed by a battery pack 25. The battery pack 25 can be placed both inside the main inner cavity 3 and outside the apparatus 1, as illustrated for example in FIG. 5.

However, it is not excluded that the electric power supply means may be different from the battery pack 25 illustrated in FIG. 5. For example, in the case of installation of the apparatus 1 in an apartment complex, it is possible that the electric power supply means are interfaced with the electrical system of the building itself.

In the event of malfunction of the electric power supply means, which typically coincides with the depletion of the respective battery pack 25, or in the event of malfunction of the locking device 6 and/or of the first user interface element 7, the opening of the movable closing element 4 would be prevented. Therefore, it is advantageous to provide an emergency opening equipment comprising a second user interface element 26 provided with connecting means 27 with the locking device 6.

The second user interface element 26 is designed to cooperate with at least one corresponding unlocking device 28 configured to perform the unlocking, by means of connecting means 27, of the locking device 6 in the event of malfunction of said locking device 6 and/or of the first user interface element 7. The emergency opening equipment can typically be activated in the case in which the movable closing element 4 remains in the closed configuration with the depleted battery pack 25.

For example, the second user interface element 26 can be formed by a connection socket, whereas the unlocking device 28 connectable to said second user interface element 26 can be formed by an external battery pack. In this embodiment, the connecting means 27 are therefore formed by one or more electric cables.

Alternatively, the second user interface element 26 could be formed by a shaped slot, whereas the unlocking device 28 connectable to said second user interface element 26 could be formed by a mechanical component (emergency key) shaped in a compatible manner with the aforementioned shaped slot. In this embodiment, the connecting means 27 could be formed by a bolt.

In any case, the second user interface element 26, the unlocking device 28 and the connecting means 27 can be respectively formed by any other type of device which allows to open the movable closing element 4 in case of malfunction of the locking device 6. The second user interface element 26 can be arranged on the lower surface of the bottom wall 21 of the body 2, as shown in FIG. 5.

In one preferred embodiment, the apparatus 1 can be provided with at least one second inner cavity 29 which is separate from both the inner main cavity 3 and the movable closing element 4 of said main inner cavity 3. This second inner cavity 29, which can, for example, be made in the form of a through hole and without closing elements, can have the function of containing magazines, newspapers, advertising leaflets and, in general, any mail item that does not need to be enclosed in the main inner cavity 3 by means of the respective movable closing element 4. The second inner cavity 29 could also be provided with its own closing means (not shown) which are independent and separate from both the movable closing element 4 of the main inner cavity 3 and the emergency opening equipment.

Finally, the apparatus 1 can also be provided with fixing or supporting members, not illustrated, which allow the fixing thereof to a wall or railing, on various types of enclosures, or on a suitable stand.

The operation of the mailbox 1 according to the invention is as follows.

First of all, the apparatus 1 is installed in a pre-selected position such as to allow the postal carrier to insert the mail in a convenient manner.

The nature of the locking and/or unlocking signal to be input is then chosen, for example the code when the first user interface element 7 provides for a numeric or alphanumeric keypad, or the fingerprints of the persons authorized to open the mailbox 1 are inserted, if the first user interface element 7 provides a fingerprint reader.

Once the apparatus 1 is installed, it can be used like any conventional mailbox. The postal carrier inserts the mail through the slot 5, after having lifted the movable protection element 8.

Users can retrieve the mail by inputting the unlocking signal of the locking device 6 through the first user interface element 7, whether it is a numeric keypad, fingerprint reader or other.

It is possible to provide a single signal which allows both the locking and the unlocking of the locking device 6, but it is also possible to provide two different signals, in particular two different codes.

The movable closing element 4 opens, being accompanied by the supporting element 9 while opening. Users can then withdraw the mail, and then close the movable closing element 4 again.

The locking device 6 can be locked again by inputting a locking signal (identical or different from the unlocking signal) or it is possible to provide that the locking device 6 is automatically locked upon the closing of the apparatus 1.

In the case of malfunction of the locking device 6 and/or of the first user interface element 7, the user can have an appropriate unlocking element 28 which, once coupled with the second user interface element 26, allows to open the movable closing element 4 for restoring the functions of the locking device 6 and/or of the first user interface element 7.

In any case, the user can have an additional compartment, formed by the second inner cavity 29, which is not constrained to the movable closing element 4 nor to the emergency opening equipment. This additional, unprotected compartment can still be used for collecting and withdrawing valueless mail items, such as advertising material.

The invention claimed is:

1. An apparatus (1) for receiving mail, comprising:

a body (2) provided with a main inner cavity (3), configured for containing at least one mail item, and with a movable closing element (4), configured for allowing or preventing access to said main inner cavity (3);

a through opening (5), configured for allowing said mail item to be inserted inside said main inner cavity (3);

a locking device (6) of said movable closing element (4), said locking device (6) being electronically actuated, said locking device (6) comprising a first user interface element (7) configured for allowing the input of a signal for locking and/or unlocking the locking device (6), said first user interface element (7) being accessible from outside the apparatus (1) for receiving mail; and electric power supply means (25) configured for respectively supplying said locking device (6) and said first user interface element (7), wherein the apparatus (1) comprises an emergency opening equipment comprising a second user interface element (26), provided with connecting means (27) with the locking device (6), and at least one unlocking device (28) configured for unlocking the locking device (6) by means of said connecting means (27), in the event of malfunction of said locking device (6), or of said electric power supply means (25) and/or of said first user interface element (7), the apparatus (1) being characterized in that the second user interface element (26) is formed by a connection socket, the unlocking device (28) connectable to said second user interface element (26) is formed by an external battery pack, and the connecting means (27) are formed by one or more electric cables, wherein the electric power supply means are formed by a battery pack (25) arranged on the outside of said apparatus (1).

2. The apparatus (1) according to claim 1, characterized in that said first user interface element (7) comprises an alphanumeric or numeric keypad.

3. The apparatus (1) according to claim 1, characterized in that said first user interface element (7) is selected from the group consisting of:

a fingerprint reader;
a programmable key card;
an RFID proximity system;
an NFC proximity system;
a Bluetooth system;
a speech recognition and control system;
a remote-control system via Wi-Fi connection;
a smartphone application;
one or more biometric recognition sensors; and
one or more owner identifying sensors.

4. The apparatus (1) according to claim 1, comprising a movable protection element (8) adapted to be moved between a first position, in which said movable protection element (8) covers said first user interface element (7), and a second position, in which said movable protection element (8) allows free access to said first user interface element (7).

5. The apparatus (1) according to claim 4, wherein the movable protection element (8), when covering said first user interface element (7), also covers the through opening (5).

6. The apparatus (1) according to claim 1, wherein the locking device (6) is arranged on an inner surface (24B) of the movable closing element (4).

7. The apparatus (1) according to claim 1, comprising a counter-locking device (60) arranged inside the main inner cavity (3).

8. The apparatus (1) according to claim 1, comprising a supporting element (9) of the movable closing element (4), adapted to support said movable closing element (4) when it is in the open position.

9. The apparatus (1) according to claim 8, wherein the supporting element (9) is pneumatic and comprises a piston (9A) inserted in a sliding manner in a cylindrical body (9B).

10. The apparatus (1) according to claim 1, comprising at least a second inner cavity (29), which is separated from both said main inner cavity (3) and the movable closing element (4) of said main inner cavity (3).

11. An apparatus (1) for receiving mail, comprising:

a body (2) provided with a main inner cavity (3), configured for containing at least one mail item, and with a movable closing element (4), configured for allowing or preventing access to said main inner cavity (3);

a through opening (5), configured for allowing said mail item to be inserted inside said main inner cavity (3);

a locking device (6) of said movable closing element (4), said locking device (6) being electronically actuated, said locking device (6) comprising a first user interface element (7) configured for allowing the input of a signal for locking and/or unlocking the locking device (6), said first user interface element (7) being accessible from outside the apparatus (1) for receiving mail; and an electric power supply (25) configured for respectively supplying power to said locking device (6) and said first user interface element (7), wherein the apparatus (1) comprises an emergency opening equipment comprising a second user interface element (26), provided with connecting means (27) with the locking device (6), and at least one unlocking device (28) configured for unlocking the locking device (6) by means of said connecting means (27), in the event of malfunction of said locking device (6), or of said electric power supply (25) and/or of said first user interface element (7), the second user interface element (26) formed by a shaped slot, the unlocking device (28) connectable to said second user interface element (26) formed by a mechanical component shaped in a manner compatible with said shaped slot, and the connecting means (27) are formed by a bolt.

* * * * *